US010353325B2

(12) United States Patent
Azzam et al.

(10) Patent No.: US 10,353,325 B2
(45) Date of Patent: Jul. 16, 2019

(54) LIQUID ELECTROPHOTOGRAPHIC COMPOSITION

(71) Applicant: HP Indigo B.V., Amstelveen (NL)

(72) Inventors: Tony Azzam, Nazareth (IL); Ilanit Mor, Kiryat Ono (IL); Samer Farran, Nes Ziona (IL); Giries Kadis, Jaffa (IL); Guy Nesher, Nes Ziona (IL); Getahun Biadglin, Beth-She'an (IL); Haim Cohen, Modiin (IL); Benjamin Dayan, Tel-Aviv (IL); Yael Kowal-Blau, Givataim (IL); Albert Teishev, Rishon le-zion (IL); Nurit Carmel-Barnea, Nes Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 15/542,614

(22) PCT Filed: Jan. 21, 2015

(86) PCT No.: PCT/EP2015/051164
§ 371 (c)(1),
(2) Date: Jul. 10, 2017

(87) PCT Pub. No.: WO2016/116151
PCT Pub. Date: Jul. 28, 2016

(65) Prior Publication Data

US 2018/0267439 A1 Sep. 20, 2018

(51) Int. Cl.

| | |
|---|---|
| ***G03G 9/087*** | (2006.01) |
| ***G03G 15/20*** | (2006.01) |
| ***G03G 9/13*** | (2006.01) |
| ***G03G 9/08*** | (2006.01) |

(52) U.S. Cl.
CPC ..... *G03G 15/2007* (2013.01); *G03G 9/0821* (2013.01); *G03G 9/08728* (2013.01); *G03G 9/08733* (2013.01); *G03G 9/132* (2013.01); *G03G 9/133* (2013.01); *G03G 15/2064* (2013.01); *G03G 2215/0081* (2013.01)

(58) Field of Classification Search
CPC ..... G03G 9/131; G03G 9/133; G03G 9/13; G03G 9/08791
See application file for complete search history.

(56) References Cited

U.S. PATENT DOCUMENTS

| | | | | |
|---|---|---|---|---|
| 6,819,886 | B2 | 11/2004 | Runkowske et al. | |
| 6,912,370 | B2 | 6/2005 | Iwai | |
| 8,086,154 | B2 | 12/2011 | Law et al. | |
| 8,417,156 | B2 | 4/2013 | Mera et al. | |
| 8,718,528 | B2 | 5/2014 | Zhang et al. | |
| 2006/0115306 | A1 | 6/2006 | Lofthus et al. | |
| 2011/0183254 | A1* | 7/2011 | Shoshi | G03G 15/10 430/112 |
| 2013/0183067 | A1 | 7/2013 | Degott et al. | |
| 2014/0113082 | A1 | 4/2014 | Ohnishi | |

FOREIGN PATENT DOCUMENTS

| | | |
|---|---|---|
| EP | 0823670 | 2/1998 |
| EP | 2348363 | 7/2011 |

OTHER PUBLICATIONS

International Search Report and Written Opinion for International Application No. PCT/EP2015/051164 dated Sep. 30, 2015, 10 pages.

Kawamura, Koichi et al, "A facile approach to the fabrication of ultrathin polymer films and application to optical lenses", Polymer 51 (2010); pp. 4562-4570.

* cited by examiner

*Primary Examiner* — Peter L Vajda
(74) *Attorney, Agent, or Firm* — HP Inc. Patent Department

(57) ABSTRACT

The present disclosure relates to a liquid electrophotographic composition comprising: a polymer resin comprising a side group comprising a cross-linkable moiety; and a carrier liquid.

12 Claims, 2 Drawing Sheets

LIQUID ELECTROPHOTOGRAPHIC COMPOSITION

BACKGROUND

Electrostatic or electrophotographic printing processes typically involve creating an image on a photoconductive surface, applying an ink having charged particles to the photoconductive surface, such that they selectively bind to the image, and then transferring the charged particles in the form of the image to a print substrate.

The photoconductive surface is typically on a cylinder and is often termed a photo imaging plate (PIP). The photoconductive surface is selectively charged with a latent electrostatic image having image and background areas with different potentials. For example, an electrostatic ink composition comprising charged toner particles in a carrier liquid can be brought into contact with the selectively charged photoconductive surface. The charged toner particles adhere to the image areas of the latent image while the background areas remain clean. The image is then transferred to a print substrate (e.g. paper) directly or, more commonly, by being first transferred to an intermediate transfer member, which can be a soft swelling blanket, and then to the print substrate.

Overprint varnishes are known and are used to enhance appearance and protect printed materials.

DETAILED DESCRIPTION

Figure 1:
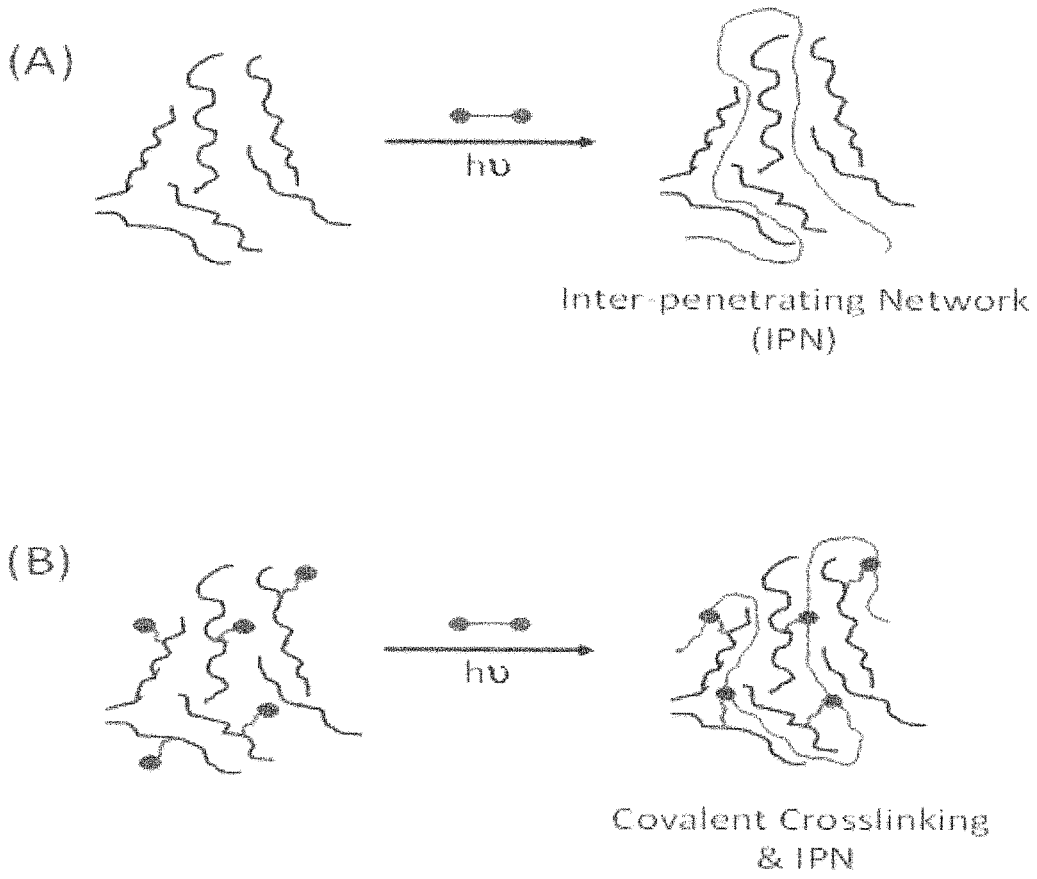
FIG. 1 shows schematic illustrations of polymer resin curing.

Before the present disclosure is disclosed and described, it is to be understood that this disclosure is not limited to the particular process steps and materials disclosed herein because such process steps and materials may vary somewhat. It is also to be understood that the terminology used herein is used for the purpose of describing particular embodiments. The terms are not intended to be limiting because the scope is intended to be limited by the appended claims and equivalents thereof.

It is noted that, as used in this specification and the appended claims, the singular forms "a," "an," and "the" include plural referents unless the context clearly dictates otherwise.

As used herein, "carrier fluid", "carrier liquid," "carrier," or "carrier vehicle" refers to the fluid in which the polymers, particles, colorant, charge directors and other additives can be dispersed to form a liquid electrostatic composition or electrophotographic composition. The carrier liquids may include a mixture of a variety of different agents, such as surfactants, co-solvents, viscosity modifiers, and/or other possible ingredients.

As used herein, "liquid electrophotographic composition" generally refers to a composition, which may be in liquid or powder form, that is typically suitable for use in an electrophotographic printing process and which is free from pigment. The liquid electrophotographic composition may comprise chargeable particles of a resin, which may be as described herein, dispersed in a carrier liquid, which may be as described herein.

As used herein, "varnish" in the context of the present disclosure refers to substantially colourless, clear or transparent compositions substantially free from pigment. As the compositions are substantially free from pigment, they may be used as varnishes in the methods described herein without contributing a further subtractive effect on the CMYK inks that would substantially affect the colour of an underprinted coloured image. It will be understood that other effects such as gamut expansion, saturation and brightness nevertheless may be enhanced.

As used herein, "co-polymer" refers to a polymer that is polymerized from at least two monomers.

As used herein, "melt flow rate" generally refers to the extrusion rate of a resin through an orifice of defined dimensions at a specified temperature and load, usually reported as temperature/load, e.g. 190° C./2.16 kg. Flow rates can be used to differentiate grades or provide a measure of degradation of a material as a result of molding. In the present disclosure, "melt flow rate" is measured per ASTM D1238-04c Standard Test Method for Melt Flow Rates of Thermoplastics by Extrusion Plastometer, as known in the art. If a melt flow rate of a particular polymer is specified, unless otherwise stated, it is the melt flow rate for that polymer alone, in the absence of any of the other components of the electrostatic composition.

As used herein, "acidity," "acid number," or "acid value" refers to the mass of potassium hydroxide (KOH) in milligrams that neutralizes one gram of a substance. The acidity of a polymer can be measured according to standard techniques, for example as described in ASTM D1386. If the acidity of a particular polymer is specified, unless otherwise stated, it is the acidity for that polymer alone, in the absence of any of the other components of the liquid toner composition.

As used herein, "melt viscosity" generally refers to the ratio of shear stress to shear rate at a given shear stress or shear rate. Testing is generally performed using a capillary rheometer. A plastic charge is heated in the rheometer barrel and is forced through a die with a plunger. The plunger is pushed either by a constant force or at constant rate depending on the equipment. Measurements are taken once the system has reached steady-state operation. One method used is measuring Brookfield viscosity @ 140° C., units are mPa-s or cPoise, as known in the art. Alternatively, the melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate. If the melt viscosity of a particular polymer is specified, unless otherwise stated, it is the melt viscosity for that polymer alone, in the absence of any of the other components of the electrostatic composition.

A certain monomer may be described herein as constituting a certain weight percentage of a polymer. This indicates that the repeating units formed from the said monomer in the polymer constitute said weight percentage of the polymer.

If a standard test is mentioned herein, unless otherwise stated, the version of the test to be referred to is the most recent at the time of filing this patent application.

As used herein, "electrostatic printing" or "electrophotographic printing" generally refers to the process that provides an image that is transferred from a photo imaging substrate either directly or indirectly via an intermediate transfer member to a print substrate. As such, the image is not substantially absorbed into the photo imaging substrate on which it is applied. Additionally, "electrophotographic printers" or "electrostatic printers" generally refer to those printers capable of performing electrophotographic printing or electrostatic printing, as described above. "Liquid electrophotographic printing" is a specific type of electrophotographic printing where a liquid composition is employed in the electrophotographic process rather than a powder toner. An electrostatic printing process may involve subjecting the electrostatic composition to an electric field, e.g. an electric field having a field gradient of 50-400V/μm, or more, ins some examples 600-900V/μm, or more.

As used herein, "substituted" may indicate that a hydrogen atom of a compound or moiety is replaced by another atom such as a carbon atom or a heteroatom, which is part of a group referred to as a substituent. Substituents include, for example, alkyl, alkoxy, aryl, aryloxy, alkenyl, alkenoxy, alkynyl, alkynoxy, thioalkyl, thioalkenyl, thioalkynyl, thioaryl, etc.

As used herein, "heteroatom" may refer to nitrogen, oxygen, halogens, phosphorus, or sulfur.

As used herein, "alkyl", or similar expressions such as "alk" in alkaryl, may refer to a branched, unbranched, or cyclic saturated hydrocarbon group, which may, in some examples, contain from 1 to about 50 carbon atoms, or 1 to about 40 carbon atoms, or 1 to about 30 carbon atoms, or 1 to about 10 carbon atoms, or 1 to about 5 carbon atoms for example.

The term "aryl" may refer to a group containing a single aromatic ring or multiple aromatic rings that are fused together, directly linked, or indirectly linked (such that the different aromatic rings are bound to a common group such as a methylene or ethylene moiety). Aryl groups described herein may contain, but are not limited to, from 5 to about 50 carbon atoms, or 5 to about 40 carbon atoms, or 5 to 30 carbon atoms or more, and may be selected from, phenyl and naphthyl.

As used herein, the term "about" is used to provide flexibility to a numerical range endpoint by providing that a given value may be a little above or a little below the endpoint to allow for variation in test methods or apparatus. The degree of flexibility of this term can be dictated by the particular variable and would be within the knowledge of those skilled in the art to determine based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not just the numerical values explicitly recited as the limits of the range, but also to include all the individual numerical values or sub-ranges encompassed within that range as if each numerical value and sub-range is explicitly recited. As an illustration, a numerical range of "about 1 wt % to about 5 wt %" should be interpreted to include not just the explicitly recited values of about 1 wt % to about 5 wt %, but also include individual values and subranges within the indicated range. Thus, included in this numerical range are individual values such as 2, 3.5, and 4 and sub-ranges such as from 1-3, from 2-4, and from 3-5, etc. This same principle applies to ranges reciting a single numerical value. Furthermore, such an interpretation should apply regardless of the breadth of the range or the characteristics being described.

As used herein, wt % values are to be taken as referring to a weight-for-weight (w/w) percentage of solids in the varnish composition, and not including the weight of any carrier fluid present.

The present disclosure relates to an electrophotographic comprising:

a polymer resin comprising a side group comprising a cross-linkable moiety comprising an unsaturated carbon-carbon bond; and a carrier liquid.

The present disclosure also relates to a method of manufacturing a polymer resin for use in a liquid electrophotographic composition, said method comprising reacting a polymer resin comprising acid side groups with a compound of the formula:

[E]-[B]-[D]

wherein

[E] comprises an epoxy group;

[B] is a substituted or unsubstituted hydrocarbyl linker group, and

[D] is a group comprising a cross-linkable moiety comprising an unsaturated carbon-carbon bond.

The present disclosure further relates to a method of electrophotographic printing, comprising printing the liquid electrophotographic composition described herein onto a substrate and curing the printed ink composition, optionally using UV radiation, for example, UV-LED radiation.

It has been found that, by incorporating cross-linkable moieties into the side groups of the polymer resin, it is possible to produce an electrophotographic composition with improved characteristics. Specifically, upon curing (e.g. by UV), the electrophotographic composition forms a durable and/or scratch resistant coating, making the composition suitable for use, for instance, as a varnish for electrophotographically printed ink. Without wishing to be bound by any theory, the cross-linkable moieties allow covalent bonds to be formed between polymer chains, producing a covalently-linked polymer network. In some examples, a crosslinking agent, for example, a multi-functional monomer, may be included in the electrophotographic composition. This crosslinking agent may also polymerise to form polymer chains that intertwine with the covalently linked polymer chains as an inter-penetrating polymer network.

The diagrams shown in FIG. 1 illustrate schematically what is believed to happen to the polymer resins upon curing. Diagram (A) illustrates how curing occurs exclusively as a result of polymerisation of the added crosslinking agent. The crosslinking agent monomers polymerise to produce a newly formed polymer that fills the gaps between the polymer resin chains as an inter-penetrating polymer network (IPN). This cross-linking mechanism dominates when the initial polymer resin is devoid of cross-linkable moieties and, as a result, cannot actively participate in polymerisation. Diagram (B) illustrates how curing occurs when the polymer resin comprises side chains comprising cross-linkable moieties. These moieties can be cross-linked to form covalent bonds that link the polymer resin chains together, providing a coating with improved properties, for example, durability and scratch resistance. Any cross-linking agent present can also polymerise to form an interpenetrating polymer network (IPN), which can help to improve the properties of the coating further.

Unless otherwise stated, any feature described herein can be combined with any aspect or any other feature described herein.

Cross-Linkable Moiety

As described above, the electrophotographic composition of the present disclosure comprises a polymer resin comprising a side group comprising a cross-linkable moiety that comprises an unsaturated carbon-carbon bond or an epoxy group. In one example, the cross-linkable moiety may be a terminal group. Suitable cross-linkable moieties include C=C bonds. The C=C bond may be positioned at a terminal position of the side group.

In one example, the polymer resin comprises a side group having a terminal group of the formula (I):

(I)

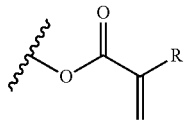

wherein R is H or alkyl. Suitable alkyl groups include alkyl groups comprising 1 to 6 carbon atoms, for example, 1 to 3 carbon atoms. Examples include methyl, ethyl, n-propyl and i-propyl. In one example, the polymer resin comprises a terminal methacrylate, ethacrylate or acrylate group. The terminal group of the formula (I) may be coupled to the polymer backbone of the polymer resin via any suitable linkage.

The side group may be coupled to the polymer backbone via any suitable linkage. In one example, the side group may be coupled to the polymer backbone via an ester linkage. In one example, the side group is coupled to the polymer backbone via an ester linkage and comprises the cross-linkable moiety at its distal end, for example, at its terminus. The cross-linkable moiety may be a terminal group. In one example, the cross-linkable moiety may be a methacrylate or an acrylate group.

The side group may have the formula:

[A]-[B]—[C]

wherein

[A] is a —C(O)O— linkage,

[B] is a substituted or unsubstituted hydrocarbyl linker group, and

[C] is a group having the formula (I)

(I)

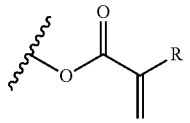

where R is H or an alkyl. Suitable alkyl groups include alkyl groups comprising 1 to 6 carbon atoms, for example, 1 to 3 carbon atoms. Examples include methyl, ethyl, n-propyl and i-propyl.

The hydrocarbyl linker group [B] may comprise 3 to 20 carbon atoms, for instance, 4 to 15 carbon atoms, for example, 8 to 12 carbon atoms. The hydrocarbyl linker may comprise a straight chain, branched or cyclic alkylene group. In one example, the hydrocarbyl linker is saturated. In one example, the hydrocarbyl group comprises a substituent, for example, an —OH substituent. The hydrocarbyl linker group may include an —OH group that is attached to a carbon that is adjacent (a) to a carbon atom to which the —C(O)O— linkage of [A] is attached.

In one example, the side group [A]-[B]—[C] has the formula II:

II

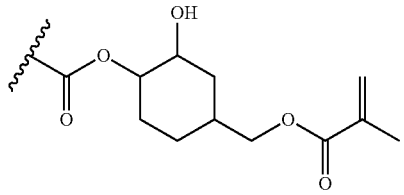

In the formula II above, [A] is an ester linkage that couples the side group to the polymer backbone. [C] is a terminal group of the formula (I) and [B] is a linker of the formula:

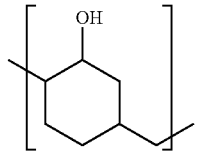

The polymer resin may be formed from a starting polymer resin comprising carboxylate or carboxylic acid groups. In one example, the starting polymer resin comprises acidic side groups, for example, carboxylic acid groups (—COOH). The starting polymer resin comprising acidic side groups may be an (i) ethylene or propylene acrylic acid co-polymer or an (ii) ethylene or propylene methacrylic acid co-polymer. Such starting polymer resins may be reacted with a compound of the formula:

[E]-[B']-[D]

wherein:

[E] comprises an epoxy group;

[B'] is a substituted or unsubstituted hydrocarbyl linker group, and

[D] is a group comprising the cross-linkable moiety.

[D] may comprise any of the cross-linkable moieties described above. In one example, the cross-linkable moiety may be a terminal group. Suitable cross-linkable moieties include C=C groups, for example, terminal C=C groups.

In one example, [D] may have a terminal group of the formula (I):

(I)

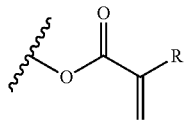

wherein R is H or alkyl. Suitable alkyl groups include alkyl groups comprising 1 to 6 carbon atoms, for example, 1 to 3 carbon atoms. Examples include methyl, ethyl, n-propyl and i-propyl. In one example, [D] comprises or is a terminal methacrylate, ethacrylate or acrylate group.

[B'] may be a hydrocarbyl linker comprising 3 to 20 carbon atoms, for instance, 4 to 15 carbon atoms, for example, 8 to 12 carbon atoms. In one example, [B'] is an unsubstituted hydrocarbyl linker. The hydrocarbyl linker may comprise a straight chain, branched or cyclic alkylene group. In one example, the hydrocarbyl linker is saturated.

In one example, the compound of the formula [E]-[B']-[D] is 3,4-Epoxycyclohexylmethyl methacrylate (ECMA).

The reaction between the starting polymer resin comprising side chains comprising carboxylic acid or carboxylate groups and the compound [E]-[B']-[D] may be carried out at elevated temperature. For example, the reaction temperature may be at least 70 degrees C., for example, at least 100 degrees C. or at least 130 degrees C. In one example, the starting polymer resin is heated to at least its melting point to facilitate the reaction.

In the reaction between the starting polymer resin comprising carboxylic acid or carboxylate groups and the compound [E]-[B']-[D], a portion of the carboxylic acid/carboxylate groups may be esterified. For example, 3 to 60 mol % of the carboxylic acid/carboxylate groups may be esterified. In one example. 5 to 30 mol %, for instance, 10 to 20 mol % of the carboxylic acid/carboxylate groups may be esterified. Thus, in one example, the polymer resin comprises carboxylic acid side groups in addition to the side groups comprising cross-linkable moieties, wherein the side groups comprising cross-linkable moieties form 3 to 60 mol % of the acid side groups in the polymer resin. In another example, the side group comprising cross-linkable moieties may form. 5 to 30 mol %, for instance, 10 to 20 mol % of the acid side groups in the polymer resin.

Figure 2:
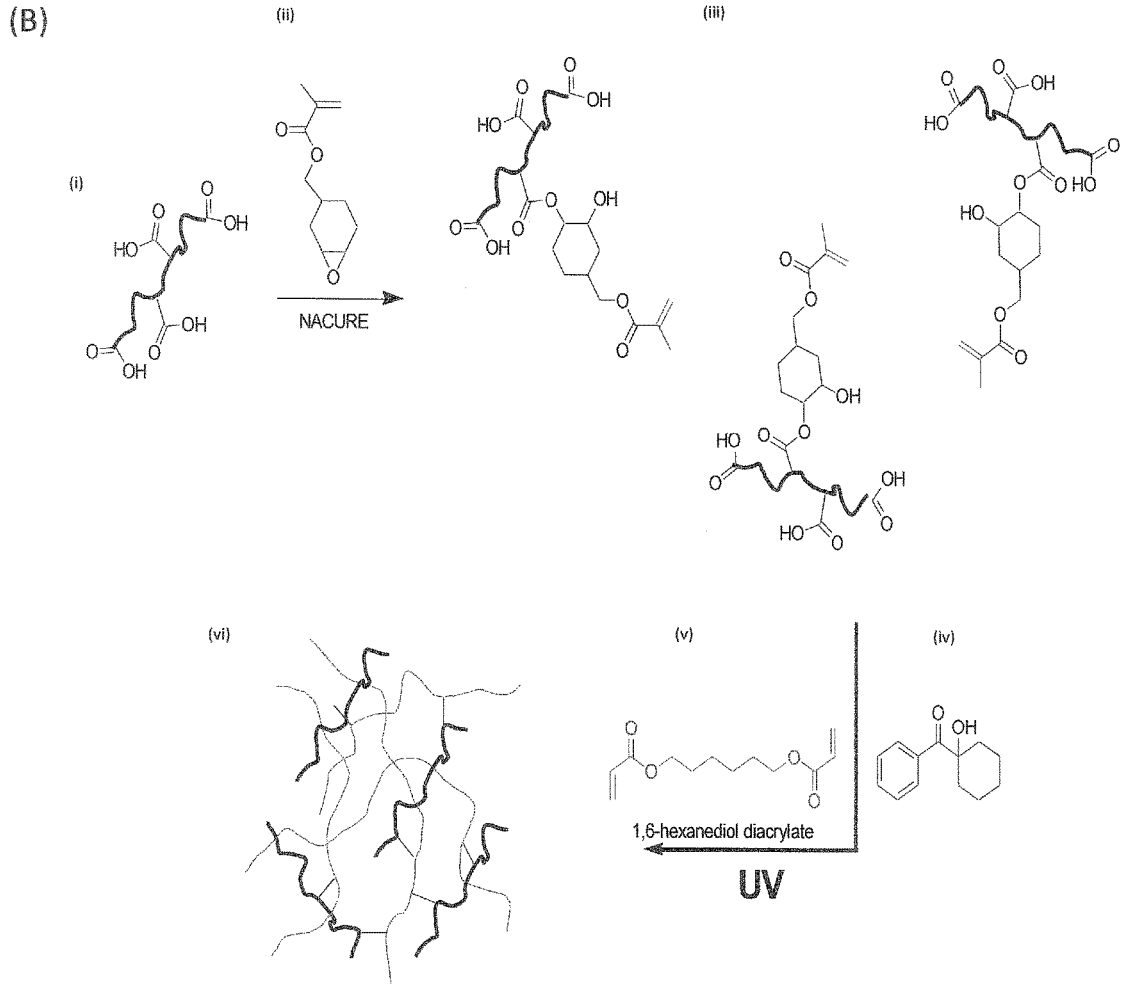
FIG. 2 schematically illustrates a reaction between a starting polymer resin having carboxylic acid side groups (i) and 3,4-Epoxycyclohexylmethyl methacrylate (ECMA) (ii).

The schematic shown in FIG. 2 illustrates, by way of example, a reaction between a starting polymer resin comprising carboxylic acid side groups (i) and 3,4-Epoxycyclohexylmethyl methacrylate (ECMA) (ii).

As can be seen from the schematic above, an ester linkage is formed as a result of the reaction between the hydroxyl group of the carboxylic acid and the epoxy-group of ECMA. The resulting polymer resin comprises a side group comprising a terminal methacrylate group as a cross-linkable moiety (iii).

As shown in the schematic and explained in further detail below, the polymer resin (iii) can, by way of example, be crosslinked in the presence of a cross-linking agent (e.g. 1,6-hexanediol diacrylate (v)) and a photoinitiator (1-hydroxy cyclohexylphenyl ketone (iv)). Upon exposure to UV (e.g. UV-LED), covalent bonds are formed from the cross-linkable moieties on the polymer resin and, where employed, the cross-linking agent to yield a highly cross-linked network (vi) where the resin chains participate in the polymerisation.

Cross-Linking Agent

The composition of the present disclosure may include a cross-linking agent (e.g. a cross-linking monomer).

The cross-linking agent may be a multi-functional cross-linker, for example, a monomer having more than one polymerizable group. In one example, the cross-linker has at least one group having the formula (I):

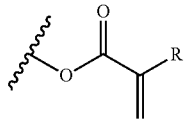

where R is H or alkyl.

The group having the formula (I) may be a terminal group.

In some examples, the cross-linker is a monomer having at least one group having the formula (i), for instance, 2 to 6 groups having the formula (I). In one example, the cross-linker is a multi-functional acrylate or a multi-functional methacrylate. For instance, the crosslinker may be a di-acrylate, tri-acrylate, tetra-, penta- or hexa-acrylate, methacrylate or mixtures thereof. For example, the cross-linker may be 1,6-hexanediol diacrylate or dipentaerythritol penta-/hexa-acrylate. Other suitable examples include the following: alkoxylated pentaerythritol acrylate, propoxylated glycerol triacrylate, ethoxylated trimethylolpropane triacrylate (TMPEOTA), trimethylolpropane triacrylate, ethoxylated 6-Trimethylolpropane Triacrylate, ethoxylated trimethylolpropane triacrylate, tripropylene glycol triacrylate, 2,2'-ethylenedioxydiethyl dimethacrylate, tris(2-hydroxyethyl)isocyanurate triacrylate), hexane-1,6-diol diacrylate, tetrahydrofurfuryl acrylate, glycerol ethoxylated, esters with acrylic acid, diethylene glycol dimethacrylate, pentaerythritol tetraacrylate (PERTA), pentaerythritol diacrylate monostearate (PERDAMS), dipentaerythritol penta-/hexa-acrylate (DPERHA) and di(trimethylolpropane) tetraacrylate (DTMPTA).

The cross-linker may be a monomer (e.g. as defined above) having a molecular weight of 225 to 525 g/mol. As discussed above, the monomer may comprise 2 to 6 acrylate or methacrylate groups. For example, the monomer may be a di-, tri-, tetra-, penta- or hexa-acrylate, methacrylate or mixtures thereof.

The cross-linker (e.g. monomer) may be present in an amount of up to 50% based on the total weight of solids in the composition, for example, up to 30% based on the total weight of solids in the composition. For instance, the cross-linker (e.g. monomer) may be present in an amount of at least 1 weight %, for example, at least 5 weight % based on the total weight of solids in the composition.

Photo-Initiator

In some examples, the composition comprises a photo-initiator. The photo-initiator, or UV initiator, is an agent that initiates a reaction upon exposure to a desired wavelength of UV light to cure the composition, as described herein, after its application to a substrate by cross-linking the polymer resin with the epoxy-based cross-linking agent. In some examples, the photo-initiator is a cationic photo-initiator or a radical photo-initiator. The photo-initiator may be a single compound or a mixture of two or more compounds. It can be present in the composition in an amount sufficient to cure the applied composition. In some examples, the photo-initiator is present in the composition in an amount representing from about 0.01 to about 10 wt %, or from about 1 to about 5 wt %. In one example the photo-initiator may be present in an amount of less than 5 wt %, for example less than 4 wt %, less than 3 wt %, less than 2 wt %, less than 1 wt %.

Examples of radical photo-initiator include, by way of illustration and not limitation, 1-hydroxy-cyclohexylphenylketone, benzophenone, 2,4,6-trimethylbenzo-phenone, 4-methylbenzophenone, diphenyl-(2,4,6-trimethylbenzoyl) phosphine oxide, phenyl bis(2,4,6-trimethylbenzoyl)phosphine oxide, 2-hydroxy-2-methyl-1-phenyl-1-propanone, benzyl-dimethyl ketal, 2-methyl-1-[4-(methylthio)phenyl]-2-morpholinopropan-1-one, or combinations of two or more of the above. Amine synergists may also be used, such as, for example, ethyl-4-dimethylaminobenzoate, 2-ethylhexyl-4-dimethylamino benzoate.

The composition may include a UV stabilizer, i.e. an agent that can assist with scavenging free radicals. Examples of UV stabilizers include, by way of illustration and not limitation, quinine methide (Irgastab®UV 22 from BASF Corporation) and Genorad®16 (Rahn USA Corporation) and combinations thereof.

In some examples, a photosensitizer may be used with the photo-initiator in amounts ranging from about 0.01 to about 10 wt %, or from about 1 to about 5 wt %, based on the total weight of the composition. A photosensitizer absorbs energy and then transfers it to another molecule, usually the photo-initiator. Photosensitizers are often added to shift the light absorption characteristics of a system. Suitable examples of photosensitizers include, but are not limited to thioxanthone, 2-isopropylthioxanthone and 4-isopropylthioxanthone.

Carrier Liquid

In some examples, the composition is or has been formed from an electrostatic composition. Before application to the print substrate in the electrostatic printing process, the composition may be in liquid form; and may comprises a carrier liquid in which is suspended particles of the thermoplastic resin. Generally, the carrier liquid can act as a dispersing medium for the other components in the composition. For example, the carrier liquid can comprise or be a hydrocarbon, silicone oil, vegetable oil, etc. The carrier liquid can include, but is not limited to, an insulating, non-polar, non-aqueous liquid that can be used as a medium for toner particles. The carrier liquid can include compounds that have a resistivity in excess of about $10^9$ ohm-cm. The carrier liquid may have a dielectric constant below about 5, in some examples below about 3. The carrier liquid can include, but is not limited to, hydrocarbons. The hydrocarbon can include, but is not limited to, an aliphatic hydrocarbon, an isomerized aliphatic hydrocarbon, branched chain aliphatic hydrocarbons, aromatic hydrocarbons, and combinations thereof. Examples of the carrier liquids include, but are not limited to, aliphatic hydrocarbons, isoparaffinic compounds, paraffinic compounds, dearomatized hydrocarbon compounds, and the like. In particular, the carrier liquids can include, but are not limited to, Isopar-G™, Isopar-H™, Isopar-L™, Isopar-M™, Isopar-K™, Isopar-V™, Norpar 12™, Norpar 13™, Norpar 15™, Exxol D40™, Exxol D80™, Exxol D100™, Exxol D130™, and Exxol D140™ (each sold by EXXON CORPORATION); Teclen N-16™, Teclen N-20™, Teclen N-22™, Nisseki Naphthesol L™, Nisseki Naphthesol M™, Nisseki Naphthesol H™, #0 Solvent L™, #0 Solvent M™, #0 Solvent H™, Nisseki Isosol 300™, Nisseki Isosol 400™, AF-4™, AF-5™, AF-6™ and AF-7™ (each sold by NIPPON OIL CORPORATION); IP Solvent 1620™ and IP Solvent 2028™ (each sold by IDEMITSU PETROCHEMICAL CO., LTD.); Amsco OMS™ and Amsco 460™ (each sold by AMERICAN MINERAL SPIRITS CORP.); and Electron, Positron, New II, Purogen HF (100% synthetic terpenes) (sold by ECOLINK™).

Before printing, the carrier liquid can constitute about 20% to 99.5% by weight of the electrostatic composition, in some examples 50% to 99.5% by weight of the electrostatic composition. Before printing, the carrier liquid may constitute about 40 to 90% by weight of the electrostatic composition. Before printing, the carrier liquid may constitute about 60% to 80% by weight of the electrostatic composition. Before printing, the carrier liquid may constitute about 90% to 99.5% by weight of the electrostatic composition, in some examples 95% to 99% by weight of the electrostatic composition.

The composition, when printed on the print substrate, may be substantially free from carrier liquid. In an electrostatic printing process and/or afterwards, the carrier liquid may be removed, e.g. by an electrophoresis processes during printing and/or evaporation, such that substantially just solids are transferred to the print substrate. Substantially free from carrier liquid may indicate that the composition printed on the print substrate contains less than 5 wt % carrier liquid, in some examples, less than 2 wt % carrier liquid, in some examples less than 1 wt % carrier liquid, in some examples less than 0.5 wt % carrier liquid. In some examples, the composition printed on the print substrate is free from carrier liquid Polymer Resin As discussed above, the composition comprises a polymer resin. The polymer resin comprises a side group comprising a cross-linkable moiety as discussed above. Other optional features of the polymer resin are discussed below.

The polymer resin may comprise a thermoplastic polymer. A thermoplastic polymer is sometimes referred to as a thermoplastic resin. In some examples, the polymer may comprise polymers selected from ethylene or propylene acrylic acid co-polymers; ethylene or propylene methacrylic acid co-polymers. As discussed above, some of the acidic side groups of the polymer resin may be reacted with a compound of the formula [E]-B']-[D]. Thus, the starting polymer resin used to prepare the polymer resin employed in the ink composition may initially contain acid groups but be initially devoid of cross-linkable moieties. However, at least some of these acidic side groups may be modified into side groups comprising a cross-linkable moiety, for example, by reaction with [E]-[B']-[D] as discussed above. In some examples, the resin comprises acidic side groups as well as side groups comprising cross-linkable moieties.

The polymer resin employed in the electrophotographic composition or the starting polymer resin used to form such a polymer resin may have an acidity of 50 mg KOH/g or more, in some examples an acidity of 60 mg KOH/g or more, in some examples an acidity of 70 mg KOH/g or more, in some examples an acidity of 80 mg KOH/g or more, in some examples an acidity of 90 mg KOH/g or more, in some examples an acidity of 100 mg KOH/g or more, in some examples an acidity of 105 mg KOH/g or more, in some examples 110 mg KOH/g or more, in some examples 115 mg KOH/g or more. The polymer having acidic side groups may have an acidity of 200 mg KOH/g or less, in some examples 190 mg or less, in some examples 180 mg or less, in some examples 130 mg KOH/g or less, in some examples 120 mg KOH/g or less. Acidity of a polymer, as measured in mg KOH/g can be measured using standard procedures known in the art, for example using the procedure described in ASTM D1386.

The polymer resin employed in the electrophotographic composition or the starting polymer resin used to form such a polymer resin may comprise a polymer that has a melt flow rate of less than about 70 g/10 minutes, in some examples about 60 g/10 minutes or less, in some examples about 50 g/10 minutes or less, in some examples about 40 g/10 minutes or less, in some examples 30 g/10 minutes or less, in some examples 20 g/10 minutes or less, in some examples 10 g/10 minutes or less.

The polymer resin employed in the electrophotographic composition or the starting polymer resin used to form such a polymer resin can have a melt flow rate of about 10 g/10 minutes to about 120 g/10 minutes, in some examples about 10 g/10 minutes to about 70 g/10 minutes, in some examples about 10 g/10 minutes to 40 g/10 minutes, in some examples 20 g/10 minutes to 30 g/10 minutes. The polymer can have a melt flow rate of, in some examples, about 50 g/10 minutes to about 120 g/10 minutes, in some examples 60 g/10 minutes to about 100 g/10 minutes. The melt flow rate can be measured using standard procedures known in the art, for example as described in ASTM D1238.

The acidic side groups of the polymer resin employed in the electrophotographic composition or the starting polymer resin may be in free acid form or may be in the form of an anion and associated with one or more counterions, typically metal counterions, e.g. a metal selected from the alkali metals, such as lithium, sodium and potassium, alkali earth metals, such as magnesium or calcium, and transition metals, such as zinc. The polymer having acidic sides groups can be selected from resins such as co-polymers of ethylene and an ethylenically unsaturated acid of either acrylic acid or methacrylic acid; and ionomers thereof, such as methacrylic acid and ethylene-acrylic or methacrylic acid co-polymers which are at least partially neutralized with metal ions (e.g. Zn, Na, Li) such as SURLYN® ionomers. The polymer comprising acidic side groups can be a co-polymer of ethylene and an ethylenically unsaturated acid of either acrylic or methacrylic acid, where the ethylenically unsaturated acid of either acrylic or methacrylic acid constitute from 5 wt % to about 25 wt % of the co-polymer, in some examples from 10 wt % to about 20 wt % of the co-polymer.

The polymer resin employed in the electrophotographic composition or the starting polymer resin used to form such a polymer resin may comprise two different polymers having acidic side groups. The two polymers having acidic side groups may have different acidities, which may fall within the ranges mentioned above. The resin may comprise a first polymer having acidic side groups that has an acidity of from 10 mg KOH/g to 110 mg KOH/g, in some examples 20 mg KOH/g to 110 mg KOH/g, in some examples 30 mg KOH/g to 110 mg KOH/g, in some examples 50 mg KOH/g to 110 mg KOH/g, and a second polymer having acidic side groups that has an acidity of 110 mg KOH/g to 130 mg KOH/g.

The polymer resin employed in the electrophotographic composition or the starting polymer resin used to form such a polymer resin may comprise two different polymers having acidic side groups: a first polymer having acidic side groups that has a melt flow rate of about 10 g/10 minutes to about 50 g/10 minutes and an acidity of from 10 mg KOH/g to 110 mg KOH/g, in some examples 20 mg KOH/g to 110 mg KOH/g, in some examples 30 mg KOH/g to 110 mg KOH/g, in some examples 50 mg KOH/g to 110 mg KOH/g, and a second polymer having acidic side groups that has a melt flow rate of about 50 g/10 minutes to about 120 g/10 minutes and an acidity of 110 mg KOH/g to 130 mg KOH/g. At least some of these acidic side groups may be converted into side groups comprising cross-linkable moieties, for example, by reaction with [E]-B']-[D].

The ratio of the first polymer having acidic side groups to the second polymer having acidic side groups can be from about 10:1 to about 2:1. The ratio can be from about 6:1 to about 3:1, in some examples about 4:1.

The polymer resin employed in the electrophotographic composition or the starting polymer resin used to form such a polymer resin may comprise a polymer having a melt viscosity of 15000 poise or less, in some examples a melt viscosity of 10000 poise or less, in some examples 1000 poise or less, in some examples 100 poise or less, in some examples 50 poise or less, in some examples 10 poise or less; said polymer may be a polymer having acidic side groups as described herein. The resin may comprise a first polymer having a melt viscosity of 15000 poise or more, in some examples 20000 poise or more, in some examples 50000 poise or more, in some examples 70000 poise or more; and in some examples, the resin may comprise a second polymer having a melt viscosity less than the first polymer, in some examples a melt viscosity of 15000 poise or less, in some examples a melt viscosity of 10000 poise or less, in some examples 1000 poise or less, in some examples 100 poise or less, in some examples 50 poise or less, in some examples 10 poise or less. The resin may comprise a first polymer having a melt viscosity of more than 60000 poise, in some examples from 60000 poise to 100000 poise, in some examples from 65000 poise to 85000 poise; a second polymer having a melt viscosity of from 15000 poise to 40000 poise, in some examples 20000 poise to 30000 poise, and a third polymer having a melt viscosity of 15000 poise or less, in some examples a melt viscosity of 10000 poise or less, in some examples 1000 poise or less, in some examples 100 poise or less, in some examples 50 poise or less, in some examples 10 poise or less; an example of the first polymer is Nucrel 960 (from DuPont), and example of the second polymer is Nucrel 699 (from DuPont), and an example of the third polymer is AC-5120 or AC-5180 (from Honeywell). The first, second and third polymers may be polymers having acidic side groups as described herein. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate.

If the resin in the composition comprises a single type of polymer, the polymer (excluding any other components of the electrostatic composition) may have a melt viscosity of 6000 poise or more, in some examples a melt viscosity of 8000 poise or more, in some examples a melt viscosity of 10000 poise or more, in some examples a melt viscosity of 12000 poise or more. If the resin comprises a plurality of polymers all the polymers of the resin may together form a mixture (excluding any other components of the electrostatic composition) that has a melt viscosity of 6000 poise or more, in some examples a melt viscosity of 8000 poise or more, in some examples a melt viscosity of 10000 poise or more, in some examples a melt viscosity of 12000 poise or more. Melt viscosity can be measured using standard techniques. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate.

The polymer resin employed in the electrophotographic composition or the starting polymer used to form such a resin may comprise two different polymers having acidic side groups that are selected from co-polymers of ethylene and an ethylenically unsaturated acid of either acrylic acid or methacrylic acid; or ionomers thereof, such as methacrylic acid and ethylene-acrylic or methacrylic acid co-polymers which are at least partially neutralized with metal ions (e.g. Zn, Na, Li) such as SURLYN® ionomers. The resin may comprise (i) a first polymer that is a co-polymer of ethylene and an ethylenically unsaturated acid of either acrylic acid and methacrylic acid, wherein the ethylenically unsaturated acid of either acrylic or methacrylic acid constitutes from 8 wt % to about 16 wt % of the co-polymer, in some examples 10 wt % to 16 wt % of the co-polymer; and (ii) a second polymer that is a co-polymer of ethylene and an ethylenically unsaturated acid of either acrylic acid and methacrylic acid, wherein the ethylenically unsaturated acid of either acrylic or methacrylic acid constitutes from 12 wt % to about 30 wt % of the co-polymer, in some examples from 14 wt % to about 20 wt % of the co-polymer, in some examples from 16 wt % to about 20 wt % of the co-polymer in some examples from 17 wt % to 19 wt % of the co-polymer. At least a portion of these acidic side groups may be converted to side groups comprising cross-linkable moieties, for example, by the reaction with [E]-B']-[D] as discussed above.

The polymer resin employed in the electrophotographic composition or the starting polymer resin used to form such a polymer resin may comprise a polymer having acidic side groups, as described above (which may be free of ester side groups), and a polymer having ester side groups. The polymer having ester side groups may be a thermoplastic polymer. The polymer having ester side groups may further comprise acidic side groups. The polymer having ester side groups may be a co-polymer of a monomer having ester side groups and a monomer having acidic side groups. The polymer may be a co-polymer of a monomer having ester side groups, a monomer having acidic side groups, and a monomer absent of any acidic and ester side groups. The monomer having ester side groups may be a monomer selected from esterified acrylic acid or esterified methacrylic acid. The monomer having acidic side groups may be a monomer selected from acrylic or methacrylic acid. The monomer absent of any acidic and ester side groups may be an alkylene monomer, including, but not limited to, ethylene or propylene. The esterified acrylic acid or esterified methacrylic acid may, respectively, be an alkyl ester of acrylic acid or an alkyl ester of methacrylic acid. The alkyl group in the alkyl ester of acrylic or methacrylic acid may be an alkyl group having 1 to 30 carbons, in some examples 1 to 20 carbons, in some examples 1 to 10 carbons; in some examples selected from methyl, ethyl, iso-propyl, n-propyl, t-butyl, iso-butyl, n-butyl and pentyl.

The polymer having ester side groups may be a co-polymer of a first monomer having ester side groups, a second monomer having acidic side groups and a third monomer which is an alkylene monomer absent of any acidic and ester side groups. The polymer having ester side groups may be a co-polymer of (i) a first monomer having ester side groups selected from esterified acrylic acid or esterified methacrylic acid, in some examples an alkyl ester of acrylic or methacrylic acid, (ii) a second monomer having acidic side groups selected from acrylic or methacrylic acid and (iii) a third monomer which is an alkylene monomer selected from ethylene and propylene. The first monomer may constitute 1% to 50% by weight of the co-polymer, in some examples 5% to 40% by weight, in some examples 5% to 20% by weight of the co-polymer, in some examples 5% to 15% by weight of the co-polymer. The second monomer may constitute 1% to 50% by weight of the co-polymer, in some examples 5% to 40% by weight of the co-polymer, in some examples 5% to 20% by weight of the co-polymer, in some examples 5% to 15% by weight of the co-polymer. The first monomer can constitute 5% to 40% by weight of the co-polymer, the second monomer constitutes 5% to 40% by weight of the co-polymer, and with the third monomer constituting the remaining weight of the co-polymer. In some examples, the first monomer constitutes 5% to 15% by weight of the co-polymer, the second monomer constitutes 5% to 15% by weight of the co-polymer, with the third monomer constituting the remaining weight of the co-polymer. In some examples, the first monomer constitutes 8% to 12% by weight of the co-polymer, the second monomer constitutes 8% to 12% by weight of the co-polymer, with the third monomer constituting the remaining weight of the co-polymer. In some examples, the first monomer constitutes about 10% by weight of the co-polymer, the second monomer constitutes about 10% by weight of the co-polymer, and with the third monomer constituting the remaining weight of the co-polymer. The polymer may be selected from the Bynel® class of monomer, including Bynel 2022 and Bynel 2002, which are available from DuPont®.

The polymer having ester side groups may constitute 1% or more by weight of the total amount of the resin polymers, e.g. thermoplastic resin polymers, in the liquid electrophotographic composition and/or the composition printed on the print substrate, e.g. the total amount of the polymer or polymers having acidic side groups and polymer having ester side groups. The polymer having ester side groups may constitute 5% or more by weight of the total amount of the resin polymers, e.g. thermoplastic resin polymers, in some examples 8% or more by weight of the total amount of the resin polymers, e.g. thermoplastic resin polymers, in some examples 10% or more by weight of the total amount of the resin polymers, e.g. thermoplastic resin polymers, in some examples 15% or more by weight of the total amount of the resin polymers, e.g. thermoplastic resin polymers, in some examples 20% or more by weight of the total amount of the resin polymers, e.g. thermoplastic resin polymers, in some examples 25% or more by weight of the total amount of the resin polymers, e.g. thermoplastic resin polymers, in some examples 30% or more by weight of the total amount of the resin polymers, e.g. thermoplastic resin polymers, in some examples 35% or more by weight of the total amount of the resin polymers, e.g. thermoplastic resin polymers, in the liquid electrophotographic composition and/or the composition printed on the print substrate. The polymer having ester side groups may constitute from 5% to 50% by weight of the total amount of the resin polymers, e.g. thermoplastic resin polymers, in the liquid electrophotographic composition and/or the composition printed on the print substrate, in some examples 10% to 40% by weight of the total amount of the resin polymers, e.g. thermoplastic resin polymers, in the liquid electrophotographic composition and/or the composition printed on the print substrate, in some examples 5% to 30% by weight of the total amount of the resin polymers, e.g. thermoplastic resin polymers, in the liquid electrophotographic composition and/or the composition printed on the print substrate, in some examples 5% to 15% by weight of the total amount of the resin polymers, e.g. thermoplastic resin polymers, in the liquid electrophotographic composition and/or the composition printed on the print substrate in some examples 15% to 30% by weight of the total amount of the resin polymers, e.g. thermoplastic resin polymers, in the liquid electrophotographic composition and/or the composition printed on the print substrate.

The polymer having ester side groups may have an acidity of 50 mg KOH/g or more, in some examples an acidity of 60 mg KOH/g or more, in some examples an acidity of 70 mg KOH/g or more, in some examples an acidity of 80 mg KOH/g or more. The polymer having ester side groups may have an acidity of 100 mg KOH/g or less, in some examples 90 mg KOH/g or less. The polymer having ester side groups may have an acidity of 60 mg KOH/g to 90 mg KOH/g, in some examples 70 mg KOH/g to 80 mg KOH/g.

The polymer having ester side groups may have a melt flow rate of about 10 g/10 minutes to about 120 g/10 minutes, in some examples about 10 g/10 minutes to about 50 g/10 minutes, in some examples about 20 g/10 minutes to about 40 g/10 minutes, in some examples about 25 g/10 minutes to about 35 g/10 minutes.

The polymer, polymers, co-polymer or co-polymers of the resin can in some examples be selected or derived (as described above) from the Nucrel family of toners (e.g. Nucrel 403™, Nucrel 407™, Nucrel 609HS™, Nucrel 908HS™, Nucrel 1202HC™, Nucrel 30707™, Nucrel 1214™, Nucrel 903™, Nucrel 3990™, Nucrel 910™, Nucrel 925™, Nucrel 699™, Nucrel 599™, Nucrel 960™, Nucrel RX 76™, Nucrel 2806™, Bynell 2002, Bynell 2014, Bynell 2020 and Bynell 2022, (sold by E. I. du PONT)), the Aclyn family of toners (e.g. Aclyn 201, Aclyn 246, Aclyn 285, and Aclyn 295), and the Lotader family of toners (e.g. Lotader 2210, Lotader, 3430, and Lotader 8200 (sold by Arkema)). One or more such resins may be modified to include a cross-linkable moiety, for example, by reaction with [E]-[B]]-[D] as described above.

The resin can constitute about 5 to 90%, in some examples about 50 to 80%, by weight of the solids of the liquid electrophotographic composition and/or the composition printed on the print substrate. The resin can constitute about 60 to 95%, in some examples about 70 to 95%, by weight of the solids of the liquid electrophotographic composition and/or the composition printed on the print substrate.

Charge Director and Charge Adjuvant

The liquid electrophotographic composition and/or the composition printed on the print substrate can comprise a charge director. A charge director can be added to an electrostatic composition to impart a charge of a desired polarity and/or maintain sufficient electrostatic charge on the particles of an electrostatic composition. The charge director may comprise ionic compounds, including, but not limited to, metal salts of fatty acids, metal salts of sulfo-succinates, metal salts of oxyphosphates, metal salts of alkyl-benzene-sulfonic acid, metal salts of aromatic carboxylic acids or sulfonic acids, as well as zwitterionic and non-ionic compounds, such as polyoxyethylated alkylamines, lecithin, polyvinylpyrrolidone, organic acid esters of polyvalent alcohols, etc. The charge director can be selected from, but is not limited to, oil-soluble petroleum sulfonates (e.g. neutral Calcium Petronate™, neutral Barium Petronate™, and basic Barium Petronate™), polybutylene succinimides (e.g. OLOA™ 1200 and Amoco 575), and glyceride salts (e.g. sodium salts of phosphated mono- and diglycerides with unsaturated and saturated acid substituents), sulfonic acid salts including, but not limited to, barium, sodium, calcium, and aluminium salts of sulfonic acid. The sulfonic acids may include, but are not limited to, alkyl sulfonic acids, aryl sulfonic acids, and sulfonic acids of alkyl succinates (e.g. see WO 2007/130069). The charge director can impart a negative charge or a positive charge on the resin-containing particles of an electrostatic composition.

The charge director can comprise a sulfosuccinate moiety of the general formula $[R_a—O—C(O)CH_2CH(SO_3^-)C(O)—O—R_b]$, where each of $R_a$ and $R_b$ is an alkyl group. In some examples, the charge director comprises nanoparticles of a simple salt and a sulfosuccinate salt of the general formula $MA_n$, wherein M is a metal, n is the valence of M, and A is an ion of the general formula $[R_a—O—C(O)CH_2CH(SO_3^-)C(O)—O—R_b]$, where each of $R_a$ and $R_b$ is an alkyl group, or other charge directors as found in WO2007130069, which is incorporation herein by reference in its entirety. As described in WO2007130069, the sulfosuccinate salt of the general formula $MA_n$ is an example of a micelle forming salt. The charge director may be substantially free or free of an acid of the general formula HA, where A is as described above. The charge director may comprise micelles of said sulfosuccinate salt enclosing at least some of the nanoparticles. The charge director may comprise at least some nanoparticles having a size of 200 nm or less, in some examples 2 nm or more. As described in WO2007130069, simple salts are salts that do not form micelles by themselves, although they may form a core for micelles with a micelle forming salt. The ions constructing the simple salts are all hydrophilic. The simple salt may comprise a cation selected from Mg, Ca, Ba, $NH_4$, tert-butyl ammonium, $Li^+$, and $Al^{+3}$, or from any sub-group thereof. The simple salt may comprise an anion selected from $SO_4^{2-}$, $PO^{3-}$, $NO_3^-$, $HPO_4^{2-}$, $CO_3^{2-}$, acetate, trifluoroacetate (TFA), $Cl^-$, Bf, $F^-$, $ClO_4^-$, and $TiO_3^{4-}$, or from any sub-group thereof. The simple salt may be selected from $CaCO_3$, $Ba_2TiO_3$, $Al_2(SO_4)$, $A1(NO_3)_3$, $Ca_3(PO_4)_2$, $BaSO_4$, $BaHPO_4$, $Ba_2(PO_4)_3$, $CaSO_4$, $(NH_4)_2CO_3$, $(NH_4)_2SO_4$, $NH_4OAc$, Tert-butyl ammonium bromide, $NH_4NO_3$, LiTFA, $Al_2(SO_4)_3$, $LiClO_4$ and $LiBF_4$, or any sub-group thereof. The charge director may further comprise basic barium petronate (BBP).

In the formula $[R_a—O—C(O)CH_2CH(SO_3—)C(O)—O—R_b]$, in some examples, each of $R_a$ and $R_b$ is an aliphatic alkyl group. In some examples, each of $R_a$ and $R_b$ independently is a $C_{6-25}$ alkyl. In some examples, said aliphatic alkyl group is linear. In some examples, said aliphatic alkyl group is branched. In some examples, said aliphatic alkyl group includes a linear chain of more than 6 carbon atoms. In some examples, $R_a$ and $R_b$ are the same. In some examples, at least one of $R_a$ and $R_b$ is $C_{13}H_{27}$. In some examples, M is Na, K, Cs, Ca, or Ba. The formula $[R_a—O—C(O)CH_2CH(SO_3)C(O)—O—R_b]$ and/or the formula $MA_n$ may be as defined in any part of WO2007130069.

The charge director may comprise (i) soya lecithin, (ii) a barium sulfonate salt, such as basic barium petronate (BPP), and (iii) an isopropyl amine sulfonate salt. Basic barium petronate is a barium sulfonate salt of a 21-26 hydrocarbon alkyl, and can be obtained, for example, from Chemtura. An example isopropyl amine sulphonate salt is dodecyl benzene sulfonic acid isopropyl amine, which is available from Croda.

In an electrostatic composition, the charge director can constitute about 0.001% to 20%, in some examples 0.01 to 20% by weight, in some examples 0.01 to 10% by weight, in some examples 0.01 to 1% by weight of the solids of the electrostatic composition and/or composition printed on the print substrate. The charge director can constitute about 0.001 to 0.15% by weight of the solids of the liquid electrophotographic composition and/or composition printed on the print substrate, in some examples 0.001 to 0.15%, in some examples 0.001 to 0.02% by weight of the solids of the liquid electrophotographic composition and/or composition printed on the print substrate. In some examples, the charge director imparts a negative charge on the electrostatic composition. The particle conductivity may range from 50 to 500 pmho/cm, in some examples from 200-350 pmho/cm.

The liquid electrophotographic composition and/or composition printed on the print substrate can include a charge adjuvant. A charge adjuvant may be present with a charge director, and may be different to the charge director, and act to increase and/or stabilise the charge on particles, e.g. resin-containing particles, of an electrostatic composition. The charge adjuvant can include, but is not limited to, barium petronate, calcium petronate, Co salts of naphthenic acid, Ca salts of naphthenic acid, Cu salts of naphthenic acid, Mn salts of naphthenic acid, Ni salts of naphthenic acid, Zn salts of naphthenic acid, Fe salts of naphthenic acid, Ba salts of stearic acid, Co salts of stearic acid, Pb salts of stearic acid, Zn salts of stearic acid, Al salts of stearic acid, Cu salts of stearic acid, Fe salts of stearic acid, metal carboxylates (e.g. Al tristearate, Al octanoate, Li heptanoate, Fe stearate, Fe distearate, Ba stearate, Cr stearate, Mg octanoate, Ca stearate, Fe naphthenate, Zn naphthenate, Mn heptanoate, Zn heptanoate, Ba octanoate, Al octanoate, Co octanoate, Mn octanoate, and Zn octanoate), Co lineolates, Mn lineolates, Pb lineolates, Zn lineolates, Ca oleates, Co oleates, Zn palmirate, Ca resinates, Co resinates, Mn resinates, Pb resinates, Zn resinates, AB diblock co-polymers of 2-ethylhexyl methacrylate-co-methacrylic acid calcium, and ammonium salts, co-polymers of an alkyl acrylamidoglycolate alkyl ether (e.g. methyl acrylamidoglycolate methyl ether-co-vinyl acetate), and hydroxy bis(3,5-di-tert-butyl salicylic) aluminate monohydrate. In some examples, the charge adjuvant is aluminium di and/or tristearate and/or aluminium di and/or tripalmitate.

The charge adjuvant can constitute about 0.1 to 5% by weight of the solids of the liquid electrophotographic composition and/or varnish composition printed on the print substrate. The charge adjuvant can constitute about 0.5 to 4% by weight of the solids of the liquid electrophotographic composition and/or composition printed on the print substrate. The charge adjuvant can constitute about 1 to 3% by weight of the solids of the liquid electrophotographic composition and/or composition printed on the print substrate.

Other Additives

The electrostatic composition may include an additive or a plurality of additives. The additive or plurality of additives may be added at any stage of the method. The additive or plurality of additives may be selected from a wax, a surfactant, biocides, organic solvents, viscosity modifiers, materials for pH adjustment, sequestering agents, preservatives, compatibility additives, emulsifiers and the like. The wax may be an incompatible wax. As used herein, "incompatible wax" may refer to a wax that is incompatible with the resin. Specifically, the wax phase separates from the resin phase upon the cooling of the resin fused mixture on a print substrate during and after the transfer of the film to the print substrate, e.g. from an intermediate transfer member, which may be a heated blanket.

Varnish

As mentioned above, the electrophotographic composition of the present disclosure may be used as a varnish applied to electrophotographically printed ink. In some examples, the electrophotographic composition is an electrophotographic varnish. Electrophotographic varnish compositions can be electrophotographically printed over ink to enhance the properties of the printed image. They are typically transparent and devoid of colorants, such as pigments and dyes.

As used herein, the term "transparent" is used to describe a composition that allows light to pass therethrough. In the context of an electrophotographic varnish composition, the term "transparent" may mean that the composition allows light to pass through it such that, when the electrophotographic varnish composition is electrographically printed over a printed image of at a thickness of 3 μm or less, for instance, 1.5 to 2 μm (e.g. 1.5 μm), the printed image is clearly visible to the naked eye. In some examples, the electrophotographic varnish composition is transparent, whereby, when the electrophotographic varnish composition is electrographically printed over a printed image of at a thickness of 1.5 m, the change in optical density of the varnished image is within +/−0.05 of the optical density of the un-varnished image. Additionally or alternatively, the electrophotographic varnish composition is transparent, whereby, when the electrophotographic varnish composition is electrographically printed over a printed image of at a thickness of 1.5 m, the colours in the varnished image are substantially the same as the colours in the unvarnished image. In some examples, the difference in the colour(s) of the varnished and un-varnished image are small. Reference is made to ASTM D1729-96 (Reapproved 2009, which specifies the equipment and procedures for visual appraisal of colours and colour differences of opaque materials that are diffusely illuminated. In some examples, the delta E (determined according to CIE94) between the colours of the varnished and un-varnished image may be 3 or less, for example, 2 or less. In some examples, the delta E (determined according to CIE94) may be 1.5 or less, for example, 1 or less.

Optical density or absorbance is a quantitative measure expressed as a logarithmic ratio between the radiation falling upon a material and the radiation transmitted through a material.

$$A_\lambda = -\log_{10}\left(\frac{I_1}{I_0}\right),$$

where $A_\lambda$ is the absorbance at a certain wavelength of light ($\lambda$), $I_1$ is the intensity of the radiation (light) that has passed through the material (transmitted radiation), and $I_0$ is the intensity of the radiation before it passes through the material (incident radiation). The incident radiation may be any suitable white light, for example, day light or artificial white light. The optical density or delta E of an image may be determined using methods that are well-known in the art. For example, optical density and/or delta E may be determined using a spectrophotometer. Suitable spectrophotometers are available under the trademark X-rite.

Printing Process and Print Substrate

The electrophotographic composition of the present disclosure may be applied onto a surface in a method of electrophotographic printing.

In some examples, the surface on which the layer is formed or developed may be on a rotating member, e.g. in the form of a cylinder. The surface on which the image is formed or developed may form part of a photo imaging plate (PIP). The method may involve passing the composition between a stationary electrode and a rotating member, which may be a member having the surface having the (latent) electrostatic image thereon or a member in contact with the surface having the (latent) electrostatic image thereon. A voltage is applied between the stationary electrode and the rotating member, such that particles adhere to the surface of the rotating member. The intermediate transfer member, if present, may be a rotating flexible member, which may be heated, e.g. to a temperature of from 80 to 160° C.

In some examples, the composition is printed onto the print substrate after a printed image has been printed. In some examples, the composition is printed as a final separation, or print step, after all print separations relating to the image have been printed. References to print separation, or print step, are to be understood as referring to a single iteration of the three major transfer steps of the printing process: $t_0$ transfer of a printing composition from the binary ink developer (BID) to the photo imaging plate (PIP), followed by $t_1$ transfer (or $1^{st}$ transfer) from the PIP to the intermediate transfer member (ITM), and finally $t_2$ transfer (or 2nd transfer) from the ITM to the substrate. In CMYK printing, the ink formulations are printed in turn, or separately, hence print separations. In one example, the composition is printed as a final separation after all CMYK ink separations have taken place, i.e. all inks have been transferred to the substrate. In one example, the composition is printed simultaneously with the last ink separation.

During an electrostatic printing process, the intermediate transfer member operates at a temperature in the region of 100° C., for example about 105° C.

In the example in which the cross-linking reaction is catalysed by UV radiation in the presence of a photoinitiator, the print substrate may be exposed to a UV irradiation source shortly after the composition has been printed onto the substrate, and before image dryness. By using a polymer resin having side groups comprising crosslinkable moieties, curing can be carried out very effectively using, for example, UV-LED radiation. Unlike UV generated by mercury vapour lamps UV LED sources tend to have narrow bandwidths centred at specific wavelengths e.g. 365 and 395 nm. By using a polymer resin having side groups comprising crosslinkable moieties, it has been found that it is possible to achieve effective crosslinking UV-LED radiation, despite the narrow bandwidth of radiation produced using such sources.

The print substrate may be any suitable substrate. The substrate may be any suitable substrate capable of having an image printed thereon. The substrate may include a material selected from an organic or inorganic material. The material may include a natural polymeric material, e.g. cellulose. The material may include a synthetic polymeric material, e.g. a polymer formed from alkylene monomers, including, but not limited to, polyethylene and polypropylene, and co-polymers such as styrene-polybutadiene. The polypropylene may, in some examples, be biaxially orientated polypropylene. The material may include a metal, which may be in sheet form. The metal may be selected from or made from, for instance, aluminium (Al), silver (Ag), tin (Sn), copper (Cu), mixtures thereof. In an example, the substrate includes a cellulosic paper. In an example, the cellulosic paper is coated with a polymeric material, e.g. a polymer formed from styrene-butadiene resin. In some examples, the cellulosic paper has an inorganic material bound to its surface (before printing with ink) with a polymeric material, wherein the inorganic material may be selected from, for example, kaolinite or calcium carbonate. The substrate is, in some examples, a cellulosic print substrate such as paper. The cellulosic print substrate is, in some examples, a coated cellulosic print. In some examples, a primer may be coated onto the print substrate, before the electrostatic ink composition and composition are printed onto the print substrate.

EXAMPLES

The following illustrates examples of the methods and other aspects described herein. Thus, these Examples should not be considered as limitations of the present disclosure, but are merely in place to teach how to make examples of the present disclosure.

Materials

Polymer Resins:

Nucrel®925, Nucrel®2806 and Bynel®2022 [DuPont].

Compound [E]-[B']-[D]

3,4-Epoxycyclohexylmethyl methacrylate [Synasia Inc. (Nantong, China)].

Photoinitiators

GENOPOL TX-1 (polymeric thioxanthone derivative), GENOPOL AB-2 (Polymeric aminobenzoate derivative) [RAHN (Zurich, Switzerland)].

Irgacure®819 (Phenyl bis(2,4,6-trimethylbenzoyl)-phosphine oxide) SpeedCure 7010 (1,3-di({α-[1-chloro-9-oxo-9H-thioxanthen-4-yl)oxy]acetylpoly[oxy(1-methyl ethylene)]}oxy)-2,2-bis({α-[1-chloro-9-oxo-9H-thioxanthen-4-yl)oxy]acetyl poly[oxy(1-methylethylene)]}oxymethyl) propane), SpeedCure 7040 (a mixture of: 1,3-di({α-4-(dimethylamino)benzoylpoly[oxy(1-methylethylene)]}oxy)-2,2-bis({α-4-(dimethylamino)benzoylpoly[oxy(1-methylethylene)]}oxymethyl) propane and; {α-4-(dimethylamino) benzoylpoly(oxyethylene)-poly[oxy(1-methylethylene)]-poly(oxyethylene)} 4-(dimethylamino)benzoate) [Lambson Ltd. (Wetherby, West Yorkshire, UK)]

OMNIPOL TX (Polybutyleneglycol bis(9-oxo-9H-thioxanthenyloxy)acetate [IGM (RM Waalwijk, the Netherlands)].

Crosslinking Agents:

Laromer® PPTTA (alkoxylated pentaerythritol acrylate) Laromer® GPTA (propoxylated glycerol triacrylate) and Laromer® LR8863 (ethoxylated trimethylolpropane triacrylate (TMPEOTA)) [BASF (Ludwigshafen, Germany)].

SR351 (trimethylolpropane triacrylate), SR499 (Ethoxylated 6 Trimethylolpropane Triacrylate), SR415 (ethoxylated trimethylolproane triacrylate), SR306 (tripropylene glycol triacrylate), SR205 (2,2'-ethylenedioxydiethyl dimethacrylate), SR368 (tris(2-hydroxyethyl)isocyanurate triacrylate), SR238 (hexane-1,6-diol diacrylate), SR285 (tetrahydrofurfuryl acrylate), SR9020 (Glycerol, ethoxylated, esters with acrylic acid) and SR231 (diethylene glycol dimethacrylate) [Sartomer (Colombes Cedex, France)]

Pentaerythritol tetraacrylate (PERTA), pentaerythritol diacrylate monostearate (PERDAMS), dipentaerythritol penta-/hexa-acrylate (DPERHA), di(trimethylolpropane) tetraacrylate (DTMPTA) [Sigma-Aldrich (Rehovot, Israel)].

Preparation of Varnish Ink Dispersions

Example—1 Preparation of Methacrylate-Based Resins Paste 720 grams of Nucrel®925, 180 grams of Nucrel®2806 and 100 grams of Bynel®2022 were loaded into a Ross Mixer Paste. To this was added 1500 grams of isopar-L and the mixture was heated to 130° C. under constant mixing (50 rpm). After 1.5 h, the mixing rate was raised to 70 rpm followed by rapid addition of 10.6 grams (~3 mol %, to available acid groups) of 3,4-Epoxycyclohexylmethyl methacrylate. The heating and mixing (70 rpm) was continued for an additional 30 minutes. After, the heating was ceased while keeping the mixing at high rate (70 rpm) for additional 40 minutes, followed by reducing the mixing rate to 50 rpm and further mixing at ambient temperature for additional 12 hours. Paste formation is a very delicate process and a great care must be taken to avoid phase separation. The modified resin paste, denote as 3% methacrylate-resin paste, is stored at ambient temperature until needed. The typical percentage of the non-volatile solids (% NVS) of the formed paste is in the range of 41-43%.

A similar procedure was applied for higher degree of modification by reacting the calculated content of 3,4-Epoxycyclohexylmethyl methacrylate with the molten resins. A series of methacrylate-modified resins were prepared with a target methacrylate content ranging from 3 to 30% mol/mol (methacrylate/acid group, respectively).

Example 2—Preparation of Varnish Ink Solids

1 Kg of the methacrylate-modified resins paste of Example 1, 1.3 Kg of isopar-L (Sol-L) and 3.52 grams of the charge adjuvant (aluminum tristearate) were loaded into an attritor containing metal (or ceramic) grinding balls. The grinding process was performed at 30° C. (mixing speed of 250 rpm) for 12-15 hours. After that, grinding is ceased and a small sample from the ground was taken, dispersed in 0.1% BBP (common dispersing agent for El in Sol-L), vortexed (or sonicated) for 1 minute and applied on Malvern for particle size (PS) measurement. Grinding is terminated when the particle size reaches 1 micron or below. After that, the ground is diluted with isopar-L, mixed for few hours and transferred to a receiving container. The % NVS of the obtained varnish ink is in the range of 10-13%.

Example 2—Preparation of Varnish Working Dispersion (WD)

The varnish ink solids (10-13%, NVS) of Example 2 were allowed to mix in a shaker (200 rpm) for at least 24 h prior to processing. The pre-shaking is highly essential and is aimed to break the ink sludge, which is often formed upon prolonged storage. A 3% NVS varnish ink is prepared by diluting a predetermined solid content with Sol-L. The corresponding charge director (CD) was added at 2-15 mg/g (mg of CD per g of solid electrophotographic varnish (El), w/w) and allowed to mix in a shaker (200 rpm) for 24 h to reach sufficient charging and homogenization. The final WD weight is targeted to 3.5 KG and contains 3 wt % El (~105 grams), CD (0.525 gram at ~5 mg/g charging ratio) and ca. ~3400 grams of Sol-L.

Example 3—Preparation of Varnish WD Containing GENOPOL TX1/GENOPOL AB-2 as Two-Component UV-LED System In this typical UV formulation, 1.5 g of GENOPOL TX-1 (photoinitiator) and 1.5 g of GENOPOL AB-2 (photoinitiator and synergist) were weighed into 50 ML polypropylene (PP) Greiner centrifuge tubes. To this was added 5-20 g of SR351 (trimethylolpropane triacrylate from Sartomer) and the tube was wrapped with aluminum-foil to protect its content from light. The mixture was left to agitate on a shaker (200 rpm) for 24 h to reach a complete dissolution. Depending on the acrylate content, i.e. SR351 as in the present case, the dissolution takes an average time of 12 h to reach a complete homogenization. Heating and high-shear mixing was avoided during the dissolution of the photoinitiators in the corresponding acrylate, i.e. GENOPOL TX1/GENOPOL AB-2 in SR351, to minimize polymerization. After, the homogenized UV-additives solution was added to a pre-charged working dispersion of Example 2, followed by high-shear mixing (15K, rpm) for 5 minutes to achieve homogenization.

The same two-component UV photoinitiators, i.e. GENOPOL TX1/GENOPOL AB-2, were used with other acrylates-based systems such as Laromer® PPTTA, Laromer® GPTA, Laromer® LR8863, SR499, SR415, SR306, SR205, SR368, SR238, SR285, SR9020, SR231, PERTA, PERDAMS, DPERHA, DTMPTA, among others. The low-viscosity diacrylate diluent (SR238) was used for in conjunction with high-viscosity multi-acrylate (e.g. PERTA, DPERHA, DTMPTA, among others) at 1/1 weight ratio. Reducing the viscosity of the acrylate was found to be very beneficial to ease the introduction of the UV-additives into the WD.

Example 4—Preparation of Varnish WD Containing SpeedCure 7010/SpeedCure 7040 as an Alternative Two-Component UV-LED System Similar to the GENOPOL TX1/GENOPOL AB-2 two-component photoinitiator system, this system contains SpeedCure 7010 (photoinitiator) and SpeedCure 7040 (photoinitiator and synergist) as an alternative to GENOPOL TX1 and GENOPOL AB-2, respectively. SpeedCure 7010/SpeedCure 7040 two-component system was used with all the acrylates listed under GENOPOL TX1/GENOPOL AB-2 system.

Example 5—Preparation of Varnish WD Containing OMNIPOL TX as a Single-Component UV-LED System Similar to GENOPOL TX1/GENOPOL AB2 and SpeedCure 7010/SpeedCure 7040 as the two-component photoinitiators/synergist systems, OMNIPOL TX was used as a single-component photoinitiator with all the acrylates monomers listed under the GENOPOL TX-1/GENOPOL AB-2 system. OMNIPOL TX is often used alone without the need of synergist or photosensitizers Example 6—Preparation of Varnish WD Containing Irgacure®819 as an Alternative Single Component UV-LED System Similar to OMNIPOL TX, this system uses Irgacure®819 single-component photoinitiator with all the acrylates monomers listed under the GENOPOL TX-1/GENOPOL AB-2 system. As in OMNIPOL TX, Irgacure®819 does not require a synergist or a photosensitizer.

Example 7—UV-LED Curing Systems

The following curing system was used to cure the compositions of Examples 3 to 6.

An air-cooled Phoseon FireJet (300 mm×20 mm) UV-LED module operating at 395 nm and 12 W/cm2 irradiance, and a water-cooled Excelitas module (180 mm×20 mm) UV-LED operating at 365 nm and 14 W/cm2 irradiance were used separately for curing. Both UV modules were assembled on the proof (paper exit) at an average distance of 2 mm from the light source and the surface of the substrate. The ejected paper that passes under the UV module has an average speed of 1.3 m/sec.

Example 8—Qualitative Film-Forming Test

In this test, varnishes were produced using 0%, 5%, 10% and 15% modified-resins produced as described in Example 1. The varnishes were applied on white paper, dried and the gloss of the varnish determined by visual inspection. Gloss was best with increasing modification, with the 15% modified resin forming the best film.

Example 9—Scratch Resistance Test

In this test, the scratch resistance of a varnish composition having the following components was determined: 15% modified-resin produced as described in Example 1 as the main building block of the varnish, TX1/AB2 as the initiators at 1 wt % (each), and varying amounts of SR351 tri-functional acrylate (5%, 10% and 20% of the total solids of the varnish composition) as the crosslinker. The amount of modification was chosen to be 15%, with respect to available carboxylic acid on the resins, due to excellent film forming shown in Example 8. The formulations containing the reactive acrylates were irradiated in-line (on press) with a UV-LED lamp.

Image Printing

The varnish was printed on coloured image assembled by YMCK (yellow, magenta, cyan and key [i.e. black]) separation or part of them at a desired sequence. The ink that used to build the image was Indigo El (YMCK)

Test Methods:

Scratch—prints of circles at 400% printed, after two days samples are taken to Taber shear/scratch tester model 551. Tungsten carbide tip is installed to cause damage to print when print is fixed on iron plate. Scratch movement occurs like "phonograph" as circular scratch which evaluated by debris collected and weight.

The scratch resistance was evaluated in terms of the mass of debris collected following the scratch test described above. The results are shown in the Table 1 below. As a reference, the scratch resistance of an unvarnished ink was used as a comparison.

TABLE 1

| | Scratch Resistance (mg) (No UV) | Scratch Resistance (mg) (with UV-LED curing) |
|---|---|---|
| Reference | 0.47 | 0.47 |
| 5% SR351 | 0.067 | 0.072 |
| 10% SR351 | 0.051 | 0.045 |
| 15% SR351 | 0.046 | 0.037 |

Even without curing by UV, the printing of varnish layer containing UV reactive materials (1 hit) resulted in substantial improvement in scratch-resistance compared to reference prints without the varnish. However, when the prints were irradiated by UV after printing, the scratch-resistance improved further especially with high acrylate contents (10% to 20% SR351).

While the methods, print substrates, printing systems and related aspects have been described with reference to certain examples, those skilled in the art will appreciate that various modifications, changes, omissions, and substitutions can be made without departing from the spirit of the disclosure. It is intended, therefore, that the methods, print substrates, printing systems and related aspects be limited by the scope of the following claims. The features of any dependent claim may be combined with the features of any of the independent claims or other dependent claims.

The invention claimed is:

1. A liquid electrophotographic composition comprising:

a polymer resin comprising a side group comprising a cross-linkable moiety comprising an unsaturated carbon-carbon bond; and a carrier liquid, wherein the polymer resin comprises a side group having a terminal group of the formula (I):

(I)

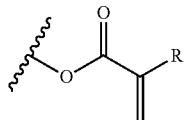

wherein R is H or alkyl.

2. A liquid electrophotographic composition comprising:

a polymer resin comprising a side group comprising a cross-linkable moiety comprising an unsaturated carbon-carbon bond; and a carrier liquid, wherein the polymer resin comprises a terminal methacrylate group.

3. A liquid electrophotographic composition comprising:

a polymer resin comprising a side group comprising a cross-linkable moiety comprising an unsaturated carbon-carbon bond; and a carrier liquid, wherein the side group is coupled to the polymer backbone via an ester linkage.

4. A composition according to claim 1, wherein the side group has the formula:

[A]-[B]-[C]

wherein

[A] is a —C(O)O— linkage,

[B] is a substituted or unsubstituted hydrocarbyl linker group, and

[C] is a group having the formula (I)

(I)

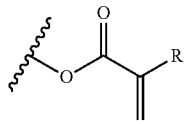

where R is H or an alkyl.

5. A composition according to claim 4, wherein the side group has the formula:

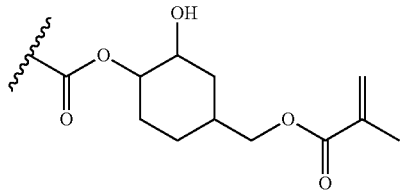

6. A composition according to claim 1, wherein the polymer resin is a reaction product of either an (i) ethylene or propylene acrylic acid co-polymer or an (ii) ethylene or propylene methacrylic acid co-polymer, and a compound of the formula:

[E]-[B']-[D]

wherein

[E] comprises an epoxy group;

[B'] is a substituted or unsubstituted hydrocarbyl linker group, and

[D] is a group comprising the cross-linkable moiety.

7. A composition according to claim 1, wherein the polymer resin comprises acid side groups in addition to the side groups comprising cross-linkable moieties, wherein the side groups comprising cross-linkable moieties form 3 to 60 mol % of the total number of acid side groups in the polymer resin.

8. A composition according to claim 1, which further comprises a crosslinking agent.

9. A composition according to claim 1, which further comprises a photoinitiator.

10. A composition according to claim 1, which further comprises a charge adjuvant.

11. A composition according to claim 1, which is an electrophotographic varnish composition.

12. A composition according to claim 8, which further comprises a photoinitiator.

* * * * *